US007399165B2

(12) United States Patent
Horiuchi et al.

(10) Patent No.: US 7,399,165 B2
(45) Date of Patent: Jul. 15, 2008

(54) PUMP UNIT WITH MULTIPLE OPERATION MODES

(75) Inventors: Hitoshi Horiuchi, Settsu (JP); Yoshiyuki Ochi, Settsu (JP); Jun Nakatsuji, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 318 days.

(21) Appl. No.: 10/516,912

(22) PCT Filed: Jun. 2, 2003

(86) PCT No.: PCT/JP03/06907

§ 371 (c)(1),
(2), (4) Date: Dec. 6, 2004

(87) PCT Pub. No.: WO03/104655

PCT Pub. Date: Dec. 18, 2003

(65) Prior Publication Data

US 2005/0180855 A1 Aug. 18, 2005

(30) Foreign Application Priority Data

Jun. 11, 2002 (JP) ..... 2002-169554

(51) Int. Cl.
*F04B 49/06* (2006.01)
*F04B 49/00* (2006.01)

(52) U.S. Cl. ..... 417/42; 417/44.2; 417/287

(58) Field of Classification Search ..... 417/42, 417/44.1, 44.2, 287
See application file for complete search history.

(56) References Cited

U.S. PATENT DOCUMENTS 3,695,783 A 10/1972 Soyland et al.
5,199,854 A * 4/1993 Aoyama ..... 417/282
5,228,289 A * 7/1993 Norton ..... 60/486

FOREIGN PATENT DOCUMENTS

| | | |
|---|---|---|
| DE | 2456929 | 8/1975 |
| GB | 1515157 | 6/1978 |
| GB | 2075132 | 11/1981 |
| JP | 51-163501 U | 12/1976 |
| JP | 53-50502 | 5/1978 |
| JP | 53-50504 | 5/1978 |
| JP | 60-100594 U | 7/1985 |
| JP | 4-92708 | 3/1992 |
| JP | 5-263768 | 10/1993 |
| WO | WO97/32128 | 9/1997 |

* cited by examiner

*Primary Examiner*—Devon Kramer
*Assistant Examiner*—Patrick Hamo
(74) *Attorney, Agent, or Firm*—Global IP Counselors

(57) ABSTRACT

A first pump of small capacity and a second pump of large capacity are connected directly with each other and are driven by a variable-speed motor. The rotational speed of the variable-speed motor is controlled by a control device. In a first mode, a first discharge line of the first pump and a second discharge line of the second pump are disconnected with each other, making the first pump unloaded. With the first pump in the unloaded state, a constant-horsepower operation is performed, where the discharge fluid is brought into a high pressure by relatively small torque. In a second mode, the first discharge line and the second discharge line are connected with each other by a switching valve. With the first and second discharge lines in the connected state, a constant-horsepower operation is performed, where a high flow rate of discharge fluid is discharged at relatively low rotational speed.

6 Claims, 4 Drawing Sheets

PUMP UNIT WITH MULTIPLE OPERATION MODES

TECHNICAL FIELD

The present invention relates to a pump unit.

CROSS-REFERENCE TO RELATED APPLICATIONS

This nonprovisional application claims priority under 35 U.S.C. §119(a) to Japanese Patent Application No. P2002-169554 filed in Japan on Jun. 11, 2002, the entire contents of which are hereby incorporated by reference.

BACKGROUND ART

Conventionally, there has been provided a pump unit shown in FIG. 4. This pump unit has a fixed-capacity type pump 52 whose rotational speed is variably driven by a variable-speed motor 51, and a controller 53 for controlling the rotational speed of the variable-speed motor 51 by changing the frequency of supply current to the motor 51. This controller 53, upon receiving a signal from a pressure sensor 54 which detects a pressure of a discharge line of the pump 52, controls the rotational speed of the variable-speed motor 51 so that the value of the pressure detected by the pressure sensor 54 becomes a specified value, thus controlling the rotational speed of the pump 52.

However, in this conventional pump unit, since one fixed-capacity type pump 52 is driven by the variable-speed motor 51, a large-torque motor or a small- and fixed-capacity type pump needs to be used in order to obtain a high pressure as the discharge pressure of the fixed-capacity type pump 52. Using the large-torque motor would cause a problem of an upsizing of the pump unit as well as an increase in cost. Also, using the small- and fixed-capacity type pump would cause the rotational speeds of the pump and the motor to become excessively large ones during high flow-rate operations, posing a problem of excessively large noise and vibrations of the pump unit.

SUMMARY OF THE INVENTION

Accordingly, an object of the present invention is to provide a pump unit capable of obtaining a high discharge pressure with use of a relatively small-torque motor, and yet capable of reducing noise and vibrations, during high flow-rate operations.

In order to achieve the aforementioned object, a pump unit of this invention comprises:

- a first fixed-capacity type pump having large capacity;
- a second fixed-capacity type pump having small capacity;
- a first discharge line connected to the first fixed-capacity type pump;
- a second discharge line connected to the second fixed-capacity type pump;
- a variable-speed motor for driving the first and second fixed-capacity type pumps;
- a switching valve for making the first discharge line and the second discharge line connected or disconnected with each other;
- a pressure sensor for detecting a pressure of the second discharge line; and
- a control device for, upon reception of a signal from the pressure sensor and a signal representing a rotational speed of the variable-speed motor, controlling the switching valve and the variable-speed motor so that operation is performed in a first mode and in a second mode, the first mode being a mode in which the first discharge line and the second line are disconnected with each other to make the first fixed-capacity type pump unloaded, in which state a constant-horsepower operation is performed, and the second mode being a mode in which the first discharge line and the second discharge line are connected with each other, in which state a constant-horsepower operation is performed.

According to the pump unit of the above-mentioned construction, by the control device, in the first mode, the switching valve is switched over into a state that the first discharge line and the second discharge line are disconnected with each other, making the first fixed-capacity type pump unloaded. In this state, by the control device which has received a signal from the pressure sensor and a signal representing a rotational speed of the variable-speed motor, the variable-speed motor is controlled so that a constant-horsepower operation in the first mode is performed.

In this first mode, since the first fixed-capacity type pump of large capacity is unloaded, a high discharge pressure can be obtained with a small discharge amount by a small-power, that is, small-sized variable-speed motor and the second fixed-capacity type pump of small capacity. Therefore, the motor does not need to be large-sized with increasingly higher discharge pressure, as would be involved in the prior art.

Also, by the control device, in the second mode, the switching valve is switched over into a state that the first discharge line and the second discharge line are connected with each other, in which state the variable-speed motor is controlled by the control device that has received a signal from the pressure sensor and a signal representing the rotational speed of the variable-speed motor, where a constant-horsepower operation is performed.

In this second mode, since the first fixed-capacity type pump of large capacity and the second fixed-capacity type pump of small capacity are driven together, a relatively high flow rate can be obtained with a relative small rotational speed of the variable-speed motor. Therefore, it does not occur that the rotational speed of the variable-speed motor or fixed-capacity type pumps becomes excessively high so that vibrations or noise of the pump unit becomes excessively large, as would occur in the prior art.

Further, in the first and second modes, since the variable-speed motor is controlled by the control device so that a constant-horsepower operation is performed, discharge pressure and flow rate are autonomously controlled without receiving any command signal from external of the pump unit. Therefore, input signal lines for commands can be omitted, allowing the wiring to be simplified, and moreover operations for inputs of the command signals become unnecessary, thus making the pump unit easier to operate.

Moreover, in one embodiment, the control device switches the switching valve from connecting state to disconnecting state when the rotational speed of the variable-speed motor has decreased below a predetermined set rotational speed, and switches the switching valve from disconnecting state to connecting state when the pressure detected by the pressure sensor has decreased below a predetermined set pressure.

According to the pump unit of the above-mentioned embodiment, the switching valve is switched over from connecting state to disconnecting state based on the rotational speed of the variable-speed motor, while the switching valve is switched over from disconnecting state to connecting state based on the detected pressure by the pressure sensor. Therefore, since the dead band of control inevitably becomes larger in width, it can be prevented that the switching valve becomes unstable between connecting state and disconnecting state. As a result, hunting of pressure and flow rate of the discharge fluid of the pump unit can be prevented.

Further, since a constant-horsepower operation is performed by the control device, and since the switching valve is switched over based on the rotational speed of the motor and the detected value of the pressure sensor, the control of discharge pressure and flow rate as well as the switching of operational mode are autonomously controlled without receiving any command signal from external of the pump unit. Therefore, input signal lines for commands can be omitted, allowing the wiring to be simplified, and moreover operations for inputs of the command signals become unnecessary, thus making the pump unit easier to operate.

Moreover, in one embodiment, the control device switches the switching valve from disconnecting state to connecting state when the rotational speed of the variable-speed motor has increased over a predetermined set rotational speed, and switches the switching valve from connecting state to disconnecting state when the pressure detected by the pressure sensor has increased over a predetermined set pressure.

According to the pump unit of the above-mentioned embodiment, the switching valve is switched over from disconnecting state to connecting state based on the rotational speed of the variable-speed motor, while the switching valve is switched over from connecting state to disconnecting state based on the detected pressure by the pressure sensor. Therefore, since the dead band of control inevitably becomes larger in width, it can be prevented that the switching valve becomes unstable between connecting state and disconnecting state. As a result, hunting of pressure and flow rate of the discharge fluid of the pump unit can be prevented.

Further, since a constant-horsepower operation is performed by the control device, and since the switching valve is switched over based on the rotational speed of the motor and the detected value of the pressure sensor, the control of discharge pressure and flow rate as well as the switching of operational mode are autonomously controlled without receiving any command signal from external of the pump unit. Therefore, input signal lines for commands can be omitted, allowing the wiring to be simplified, and moreover operations for inputs of the command signals become unnecessary, thus making the pump unit easier to operate.

Moreover, in one embodiment, the control device includes an input section from which the set rotational speed and the set pressure are variably inputted so that the first mode and the second mode are operable in a plurality of modes, respectively.

According to the pump unit of the above-mentioned embodiment, by the input section, a plurality of settings are inputted for the set rotational speed and the set pressure, respectively, so that the first mode and the second mode are operable in a plurality of modes, respectively. Thus, the pump unit can work appropriately for characteristics or operating conditions or the like of equipment to which the pump unit feeds the fluid.

DETAILED DESCRIPTION OF THE PREFERRED EMBODIMENTS

Hereinbelow, the present invention is described in detail by embodiments thereof illustrated in the accompanying drawings.

Figure 1:
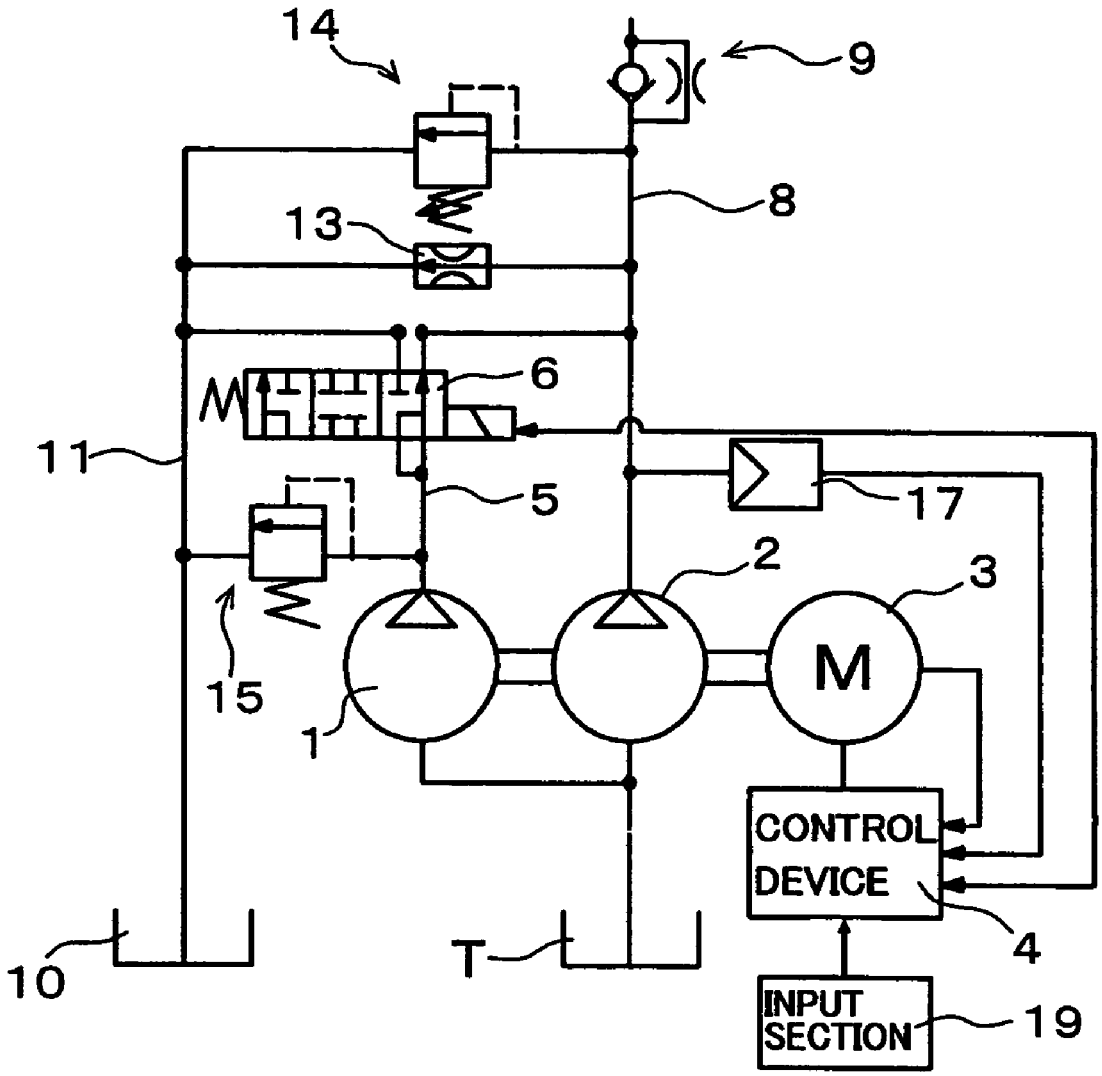
FIG. 1 is a view showing a pump unit of an embodiment of the present invention.

FIG. 1 is a view showing a pump unit of an embodiment of the present invention. This pump unit is a pump unit that feeds a working fluid of a tank T to an unshown actuator such as hydraulic cylinder. This pump unit has a first pump 1 as a first fixed-capacity type pump of large capacity, and a second pump 2 as a second fixed-capacity type pump of small capacity directly connected to the first pump 1. The first pump 1 is a gear pump of 5.5 cc/rev., and the second pump 2 is a gear pump of 3.5 cc/rev. These first pump 1 and second pump 2 are connected to a variable-speed motor 3, and this variable-speed motor 3 is electrically connected to a control device 4. An outlet port of the first pump 1 is connected to a first discharge line 5, and an outlet port of the second pump 2 is connected to a second discharge line 8. The first discharge line 5 is connected to a switching valve 6 so as to be switchable by this switching valve 6 to the second discharge line 8 or a drain line 11 leading to a tank 10. The second discharge line 8 is connected to an unshown actuator via a check valve-equipped flow-rate control valve 9. The second discharge line 8 is connected to the drain line 11 via a restrictor 13 for leaking a specified amount of working fluid, and also connected to the drain line 11 via a relief valve 14 provided in parallel to the restrictor 13. Further, a pressure sensor 17 for detecting discharge pressures of the first and second pumps 1, 2 is provided on the second discharge line 8. Meanwhile, the first discharge line 5 is connected to the drain line 11 via a relief valve 15. The control device 4 is electrically connected to an input section 19, to which such settings as maximum pressure and maximum flow rate of the working fluid discharged from the second discharge line 8 are inputted. Further, the control device 4 is electrically connected to the pressure sensor 17 and moreover connected to the motor 3 so as to be able to receive a signal indicating the rotational speed of the variable-speed motor 3.

The control device 4 is composed of an inverter section for outputting a drive current to the variable-speed motor 3, and a control section which is implemented by a microcomputer and which controls the frequency of an output current of the inverter section. By using information inputted via the input section 19, this control device calculates pressure-flow rate characteristics to be fulfilled by the first and second pumps 1, 2. Based on the pressure-flow rate characteristics, a current pressure value derived from the pressure sensor 17 and a current rotational speed of the variable-speed motor 3, the control section controls the rotational speed of the variable-speed motor 3 via the inverter section, and further controls the switching state of the switching valve 6.

In the pump unit of this embodiment, the control section of the control device 4 is so made up as to control the variable-speed motor 3 and the switching valve 6 in a first mode and a second mode. In the first mode, the first discharge line 5 is disconnected from the second discharge line 8, and a constant-horsepower operation is performed with the first pump 1 unloaded. That is, only the discharge fluid of the second pump 2 is fed out to the actuator via the second discharge line 8. In the second mode, on the other hand, constant-horsepower operation is performed with the first discharge line 5 connected to the second discharge line 8. In other words, the discharge fluid of both the first and second pumps 1, 2 is transmitted to the actuator via the second discharge line 8.

Figure 2:
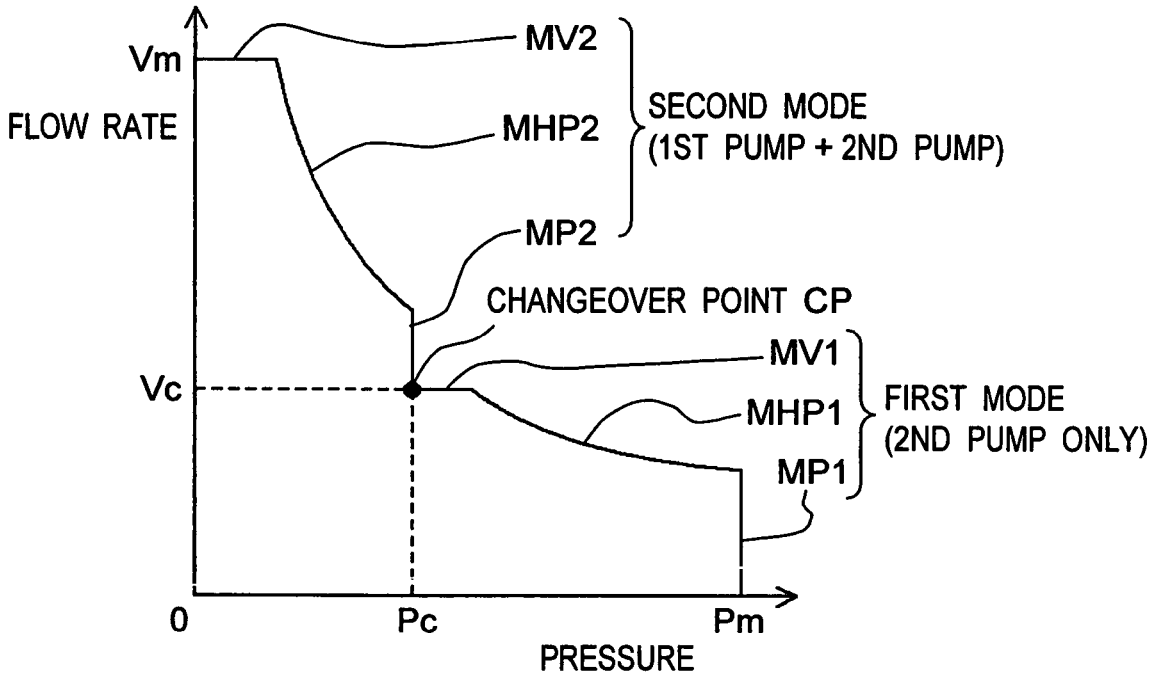
FIG. 2 is a chart in which pressure-flow rate characteristics calculated based on input information inputted from an input section are represented in two-dimensional coordinates.
Figure 3A:
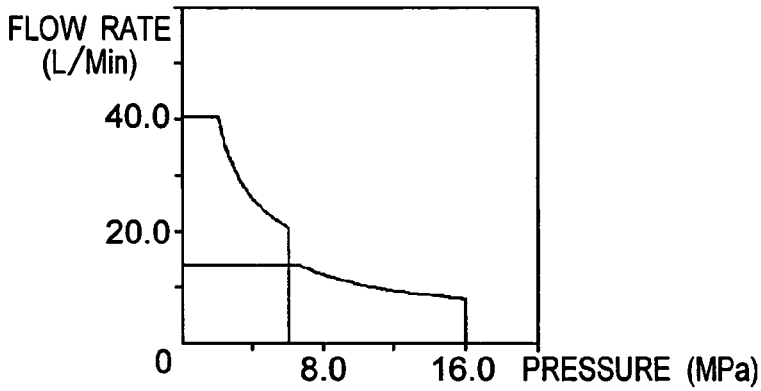
FIGS. 3A, 3B, 3C and 3D are charts showing other examples of pressure-flow rate characteristics.
Figure 3B:
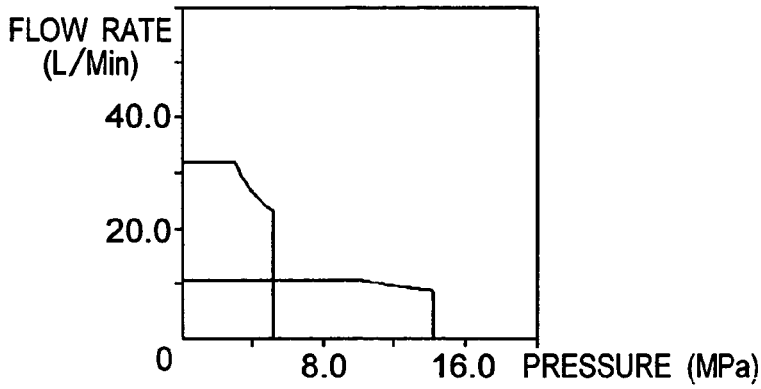
Figure 3C:
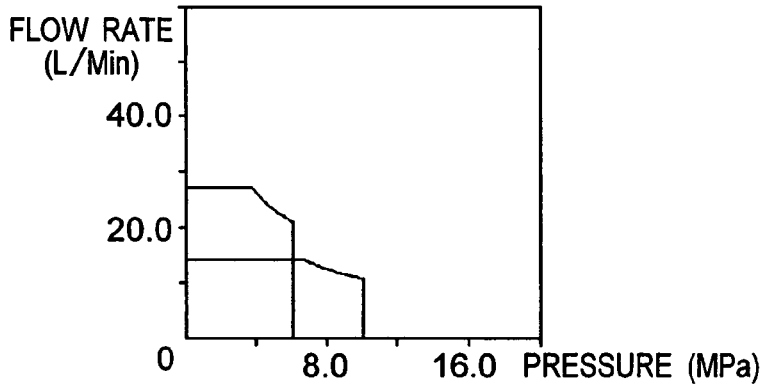
Figure 3D:
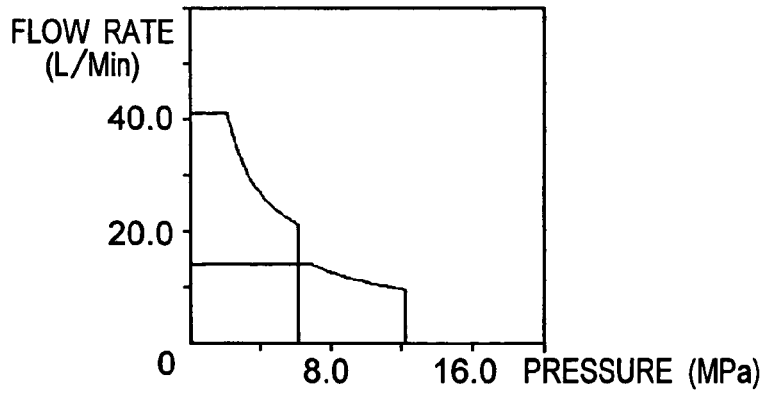
Figure 4:
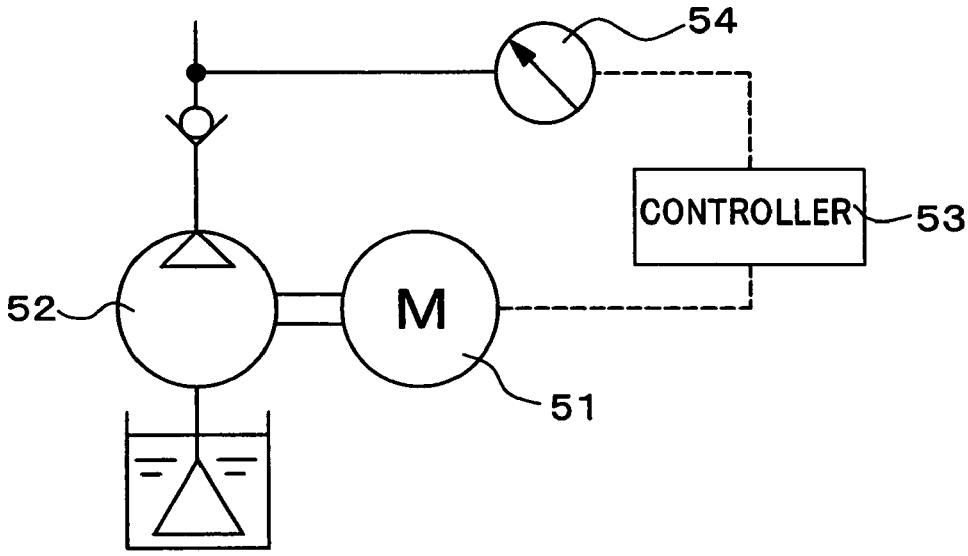
Fig. 4 BACKGROUND ART
FIG. 4 is a view showing a conventional pump unit.

FIG. 2 is a chart in which values of pressure-flow rate characteristics calculated by the control section of the control device 4 based on information inputted from the input section 19 are represented in two-dimensional coordinates showing flow rate in the vertical axis and pressure in the horizontal axis. As shown in FIG. 2, this pressure-flow rate characteristic line is composed of a first-mode portion and a second-mode portion connected to each other at a changeover point CP. The first-mode portion of the pressure-flow rate characteristic line, which is a portion related to the discharge fluid of the second pump 2 alone, is comprised of a maximum pressure line MP1, a maximum horsepower curve MHP1 and a maximum flow-rate line MV1. The second-mode portion of the pressure-flow rate characteristic line, which is a portion related to the discharge fluid of the merged flow of the first and second pumps 1, 2, is comprised of a maximum pressure line MP2, a maximum horsepower curve MHP2 and a maximum flow-rate line MV2.

When the pump unit of the above-described constitution is activated, the control section plots in the coordinates of FIG. 2 a current point determined by a current discharge pressure detected by the pressure sensor 17 and a current discharge flow rate corresponding to the rotational speed of the variable-speed motor 3. A current horsepower at this current point is calculated, and a deviation from a target horsepower on the pressure-flow rate characteristic line is determined. A control signal representing this deviation is inputted to the inverter section, and the rotational speed of the variable-speed motor 3 is controlled so as to make the current horsepower coincident with the target horsepower. As a result, pressure and flow rate of the discharge fluid derived from the second discharge line 8 fall on the pressure-flow rate characteristic line of FIG. 2. Consequently, the output of the pump unit is autonomously controlled to a maximum without depending on any command or input from external.

In a case where a large pressure is to be held but so much flow rate is not required, in order that the second pump 2 discharges a small flow rate of a point on the maximum pressure line MP1 generally parallel to the vertical axis of FIG. 2, the control device 4 makes the variable-speed motor 3 rotated at a low speed so that the pressure is held at an utmost set pressure Pm in a state of small discharge flow rate. Accordingly, it no longer occurs that the variable-speed motor 3 or the second pump 2 rotates at more than necessary rotational speeds, so that the loss of horsepower is suppressed to a small one, allowing an energy saving to be achieved, and moreover noise can be reduced.

On the other hand, in a case where a large flow rate is required but so much pressure is not required, the control device 4 makes the variable-speed motor 3 via the inverter section so that discharge pressures of the first and second pumps 1, 2 become small pressures of points on the maximum flow-rate line MV2 generally parallel to the horizontal axis (pressure axis) of FIG. 2. Accordingly, it no longer occurs that the variable-speed motor 3 or the first and second pumps 1, 2 rotate at more than necessary rotational speeds, so that the loss of horsepower is suppressed to a small one, allowing an energy saving to be achieved, and moreover noise can be reduced.

As shown above, the pump unit of this embodiment, in which the control of the rotational speed of the variable-speed motor 3 and the switching of the switching valve 6 are performed by the control device 4, is autonomously operable without depending on any command from external of the pump unit. Therefore, this pump unit is easy to operate. Also, since there are no needs for wiring or the like for reception of commands from the external, wiring for the pump unit can be reduced so that the vicinities of the installation place of this pump unit can be arranged tidily and moreover the installation work for the pump unit can be simplified.

In this case, when the discharge pressure has lowered below Pc during the operation with the discharge fluid of the second pump 2 alone, the control device 4 that has detected a decrease of the discharge pressure by the signal from the pressure sensor 17 switches over the switching valve 6. That is, the control device 4 applies a specified voltage to the solenoid of the switching valve 6 to make the first discharge line 5 connected to the second discharge line 8. Then, the control device 4 controls the rotational speed of the variable-speed motor 3 so that the merged discharge fluid of the first and second pumps 1, 2 falls on the maximum horsepower curve MHP2.

Meanwhile, when the discharge flow rate has decreased below Vc during the operation with the discharge fluids of the first and second pumps 1, 2, the control device 4 that has detected a decrease of their discharge flow rates from the rotational speed of the motor switches over the switching valve 6. That is, the control device 4 changes the application voltage to the solenoid of the switching valve 6, thereby changing the valve position, so as to make the first discharge line 5 disconnected from the second discharge line 8. Then, the control device 4 controls the rotational speed of the variable-speed motor 3 so that its output horsepower for the discharge fluid of the second pump 2 alone, from which the first pump 1 has been disconnected, falls on the maximum horsepower curve MHP1 of FIG. 2.

In the pump unit of this embodiment, the switching of the switching valve 6 from disconnecting state to connecting state is effected based on the discharge pressure of the second discharge line 8, while its switching from connecting state to disconnecting state is effected based on the discharge flow rate of the second discharge line 8. That is, the switching from disconnecting state to connecting state and the switching from connecting state to disconnecting state are effected based on mutually different detection targets. Accordingly, since the dead band of control becomes larger in width, it never occurs that the switching valve 6 is frequently switched over between connecting state and disconnecting state so as to become unstable, even if detection-targeted pressure and flow rate are increased or decreased in the vicinity of their switching reference values. As a result, hunting of flow rate and pressure of the discharge fluid can be prevented, so that the output horsepower of the pump unit can be stabilized.

The pump unit of this embodiment can be controlled based on pressure-flow rate characteristics of patterns different from the pattern shown in FIG. 2 by changing the input values of maximum pressure or maximum flow rate or the like inputted via the input section 19. FIGS. 3A, 3B, 3C, 3D are views showing pressure-flow rate characteristics obtained with inputs of changed input values of maximum pressure, maximum flow rate and maximum horsepower by way of example. In these examples, the values of maximum horsepower are set for the first-mode portion and the second-mode portion independently of each other, and besides the pressure value at which the first mode changes to the second mode, the flow rate value at which the second mode changes to the first mode, and the like are set independently of each other. Thus, since a plurality of modes can be set for the first and second modes, respectively, pressure-flow rate characteristics of the discharge fluid can appropriately be set according to the characteristics of the actuator or the like to which the pump unit feeds the working fluid. Therefore, this pump unit can feed working fluid to a plurality of actuators of different characteristics at appropriate pressure-flow rate characteristics, and moreover can manage a plurality of operating conditions of the actuator.

In this embodiment, it has been arranged that the switching valve 6 is switched over from connecting state to disconnecting state when the rotational speed of the variable-speed motor 3 has decreased below a predetermined set rotational speed, and that the switching valve 6 is switched over from disconnecting state to connecting state when the pressure detected by the pressure sensor 17 has decreased below a predetermined set pressure of Pc. However, the control may be reverse to this. That is, it may also be arranged that the switching valve 6 is switched over from disconnecting state to connecting state when the rotational speed of the variable-speed motor 3 has increased over a predetermined set rotational speed, and that the switching valve 6 is switched over from connecting state to disconnecting state when the pressure detected by the pressure sensor 17 has increased over a predetermined set pressure of Pc.

Also, in the above embodiment, the first and second pumps 1, 2 are implemented by gear pumps. However, pumps other than gear pumps, such as trochoid pumps, vane pumps or piston pumps are also usable, and any type of pump will do only if it is a fixed-capacity type pump.

In the above embodiment, the pressure-flow rate characteristic line is composed of a maximum flow-rate line, a maximum horsepower curve and a maximum pressure line. However, a pseudo maximum horsepower line made of inclined line or polygonal line may be used instead of the maximum horsepower curve. Also, the target pressure-flow rate characteristic line may be arbitrary curved line or polygonal line that is most preferable from the operation's point of view.

Further, in the above embodiment, an utmost set pressure, a maximum set flow rate, a maximum set horsepower are to be set via the input section 19. However, with use of EEPROM or flash memory, an utmost set pressure, a maximum set flow rate and a maximum set horsepower may be programmed in those mediums after or before shipping of the pump unit.

Further, in the above embodiment, flow rate of the discharge fluid is determined from the rotational speed of the variable-speed motor 3. However, it is also possible to directly detect the flow rate of the discharge fluid, for example, by setting a flow meter on the second discharge line 8.

What is claimed is:

1. A pump unit comprising:

a first fixed-capacity pump having large capacity;

a second fixed-capacity pump having small capacity that is smaller that of the first fixed-capacity pump;

a first discharge line connected to the first fixed-capacity type pump;

a second discharge line connected to the second fixed-capacity type pump;

a variable-speed motor arranged for driving the first and second fixed-capacity type pumps;

a switching valve arranged to selectively connect or disconnect the first discharge line and the second discharge line with each other;

a pressure sensor arranged to detect a pressure of the second discharge line; and a control device arranged to receive a signal from the pressure sensor and a signal representing a rotational speed of the variable-speed motor, the control device being configured to control the switching valve and the variable-speed motor so that operation is selectively performed in a first mode in which the first discharge line and the second line are disconnected with each other to make the first fixed-capacity type pump unloaded such that a constant-horsepower operation is performed, and a second mode in which the first discharge line and the second discharge line are connected with each other such that a constant-horsepower operation is performed, wherein the switching of the switching valve from connecting state to disconnecting state is effected based on whether one of the rotational speed of the variable-speed motor and the pressure detected by the pressure sensor has reached a first predetermined set value, while the switching of the switching valve from disconnecting state to connecting state is effected based on whether the other of the rotational speed of the variable-speed motor and the pressure detected by the pressure sensor has reached a second predetermined set value.

2. The pump unit according to claim 1, wherein the control device is configured to switch the switching valve from a connecting state to a disconnecting state when the rotational speed of the variable-speed motor has decreased below a predetermined set rotational speed corresponding to the first predetermined set value, and to switch the switching valve from the disconnecting state to the connecting state when the pressure detected by the pressure sensor has decreased below a predetermined set pressure corresponding to the second predetermined set value.

3. The pump unit according to claim 1, wherein the control device is configured to switch the switching valve from a disconnecting state to a connecting state when the rotational speed of the variable-speed motor has increased over a predetermined set rotational speed corresponding to the second predetermined set value, and to switch the switching valve from the connecting state to the disconnecting state when the pressure detected by the pressure sensor has increased over a predetermined set pressure corresponding to the first predetermined set value.

4. The pump unit according to claim 1, wherein the first predetermined set value corresponds to one of a predetermined set rotational speed and a predetermined set pressure, and the second predetermined set value corresponds to the other of the predetermined set rotational speed and the predetermined set pressure, and the control device includes an input section from which the predetermined set rotational speed and the predetermined set pressure are variably inputted so that the first mode and the second mode are operable in a plurality of modes, respectively.

5. The pump unit according to claim 2, wherein the control device includes an input section from which the predetermined set rotational speed and the predetermined set pressure are variably inputted so that the first mode and the second mode are operable in a plurality of modes, respectively.

6. The pump unit according to claim 3, wherein the control device includes an input section from which the predetermined set rotational speed and the predetermined set pressure are variably inputted so that the first mode and the second mode are operable in a plurality of modes, respectively.

* * * * *